US006227316B1

(12) United States Patent
Rohde

(10) Patent No.: US 6,227,316 B1
(45) Date of Patent: May 8, 2001

(54) JET BIT WITH VARIABLE ORIFICE NOZZLE

(75) Inventor: Bruce A. Rohde, Oklahoma City, OK (US)

(73) Assignee: Dresser Industries, Inc., Dallas, TX (US)

( * ) Notice: Subject to any disclaimer, the term of this patent is extended or adjusted under 35 U.S.C. 154(b) by 0 days.

(21) Appl. No.: 09/266,053

(22) Filed: Mar. 10, 1999

(51) Int. Cl.[7] ..... E21B 10/18; E21B 10/60

(52) U.S. Cl. ..... 175/340; 175/393; 175/424; 239/533.13; 239/570

(58) Field of Search ..... 175/337, 339, 175/340, 424, 331, 341, 382, 374; 239/533.13, 546, 571, 12 DJ, 602, 600, 601, 570, 547

(56) References Cited

U.S. PATENT DOCUMENTS 5,199,516 4/1993 Fernandez ..... 175/366

*Primary Examiner*—David Bagnell
*Assistant Examiner*—Kamal Dawelbeit
(74) *Attorney, Agent, or Firm*—Groover & Associates; Robert Groover; Betty Formby

(57) ABSTRACT

A nozzle for a drill bit has an adjustable orifice, allowing a single nozzle to change the pressure drop for a given flow rate. This is accomplished by the use of two plates, each having a shaped aperture therein. The degree to which the two apertures are overlapped determines the size of the orifice. The movement of the apertures, and thus the size of the orifice, can be adjusted at the drilling site.

15 Claims, 4 Drawing Sheets

JET BIT WITH VARIABLE ORIFICE NOZZLE

BACKGROUND AND SUMMARY OF THE INVENTION

The present invention relates to rotary drilling, and particularly to flow optimization of jet bits during rotary drilling.

Background: Rotary Drilling

Oil wells and gas wells are drilled by a process of rotary drilling, using a drill rig such as is shown in FIG. 1. In conventional vertical drilling, a drill bit 10 is mounted on the end of a drill string 12 (drill pipe plus drill collars), which may be several miles long, while at the surface a rotary drive (not shown) turns the drill string, including the bit at the bottom of the hole.

Two main types of drill bits are in use, one being the roller cone bit, an example of which is seen in FIG. 4. In this bit a set of cones 16 (two are visible) having teeth or cutting inserts 18 are arranged on rugged bearings such that when rotated about their separate axes, they will effectively cut through various rock formations. The second type of drill bit is a drag bit, having no moving parts, seen in FIG. 3.

During drilling operations, drilling fluid, commonly referred to as "mud", is pumped down through the drill string and out holes 28 in the drill bit 10. The flow of the mud is one of the most important factors in the operation of the drill bit, serving at least three purposes: to remove the cuttings which are sheared from rock formations by the drill bit, to cool the drill bit and teeth, and to wash away accumulations of soft material which can clog the bit. (The flow of mud also serves many other purposes, e.g. to lubricate the bearings of some rotary bit designs.)

Originally, mud was directed at the rotating roller cones, with the purpose of cleaning the cones. With the use of jet bits, in which velocities of a hundred feet per second to several hundred feet per second are common, the mud is currently directed toward the hole bottom. The turbulence created by the stream of mud will clean the bit, as well as carry away rock chips.

Background: Nozzles

Within the aperture where mud leaves the bit, removable flow-restrictors, called nozzles, determine the size of the opening, and therefore the final velocity of the mud stream. An example can be seen in FIG. 2. In this figure, a nozzle 20 has been inserted into the aperture 14, where it fits snugly. It can be held in place by any one of several means, such as a snap ring 22 (often shrouded to protect the ring from erosion from the mud), screw threads, or a nail lock (where a flexible "nail" is inserted from the edge of the bit to fit into a groove on the outside of the nozzle and inside of the aperture, locking the nozzle in place). At the inside end of the nozzle, its inside diameter is approximately that of the opening above it, while at its outside end, the diameter can be whatever is desired to give the final flow characteristics. To adjust the flow, the nozzle can be replaced with another nozzle which has a different internal diameter at the outside end.

The final inside diameter at the outside end of the nozzle is measured in increments of 1/32 of an inch, and for a single bit having a given aperture, it is not uncommon to stock 20 different sizes of nozzles. Additionally, the size of nozzle needed can not be determined in advance, only estimated, as many factors affect the choice. Thus, when a bit is shipped to the drill rig site, it is common to send perhaps four nozzles for each aperture, in appropriate sizes. The correct nozzles will be installed at the drilling site, while those which are not used are generally lost or discarded. The combination of high inventories and high waste of nozzles increases costs and wastes time, not only in the field, where the nozzles must be installed, but in the warehouse, where they must be tracked.

Variable Orifice Nozzle

The present application teaches a jet-bit nozzle which has an adjustable orifice, allowing the same nozzle to deliver the mud at variable pressures. This is accomplished by the use of two thick plates, each having a shaped aperture therein. The degree to which the two apertures are overlapped determines the size of the orifice. The movement of at least one of the plates, and thus the size of the orifice, can be adjusted at the drill site, to give a desired pressure drop across the nozzle.

The disclosed innovations, in various embodiments, provide one or more of at least the following advantages:

the nozzle can be factory installed, assuring reliable installation and quality control;

inventory can be reduced and wastage eliminated.

BRIEF DESCRIPTION OF THE DRAWING

The disclosed inventions will be described with reference to the accompanying drawings, which show important sample embodiments of the invention and which are incorporated in the specification hereof by reference, wherein.

DETAILED DESCRIPTION OF THE PREFERRED EMBODIMENTS

The numerous innovative teachings of the present application will be described with particular reference to the presently preferred embodiment (by way of example, and not of limitation).

First Embodiment—FIGS. 5–8

FIGS. 5–8 demonstrate a first embodiment of the variable-aperture nozzle which is sized to fit into existing bits. FIG. 6A shows an inner plate 70 having an aperture 74 through it. Indentations 72 in the side of the inner plate (seen as dotted lines) will provide locking points for a spring-loaded ball bearing and allow the plate to rotate to one of several predetermined positions. Other dotted lines illustrate the fact that the inside diameter at the inside end of the plate is the same as the internal diameter of the opening leading to the nozzle, but this quickly tapers to a kidney-shaped aperture at the bottom of the plate. FIG. 6B shows a side view of the top plate.

Figure 7A:
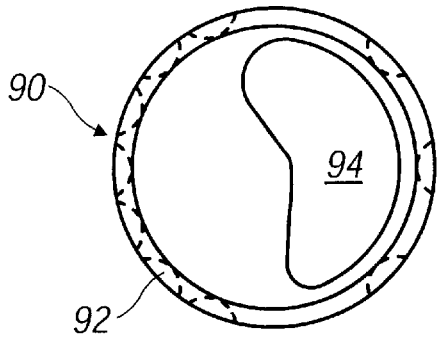
FIG. 7A–B show respectively a view of the bottom and side of the outer ring of the variable-aperture nozzle.
Figure 6B:
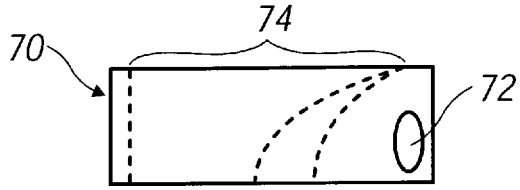
Figure 7B:
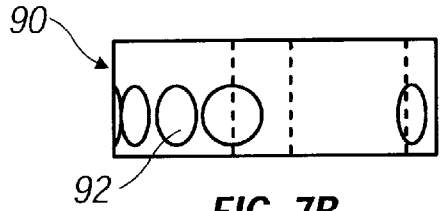

FIG. 7A shows a similar outer plate 90 with a kidney-shaped aperture 94 maintained through the disk. The outer plate has a larger number of indentations 92 on the side of the plate, allowing a larger number of seating positions when the disk is rotated. FIG. 7B shows a side view of this plate.

Figure 8:
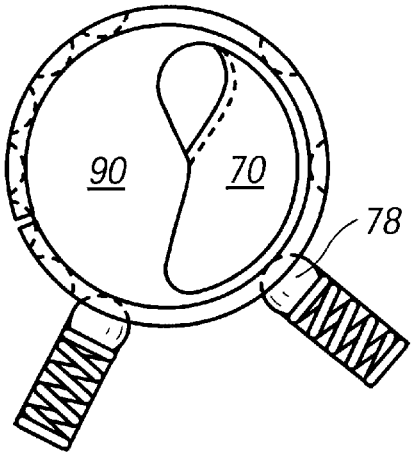
FIG. 8 shows a view of the two plates of the variable-aperture nozzle overlying each other.
Figure 9:
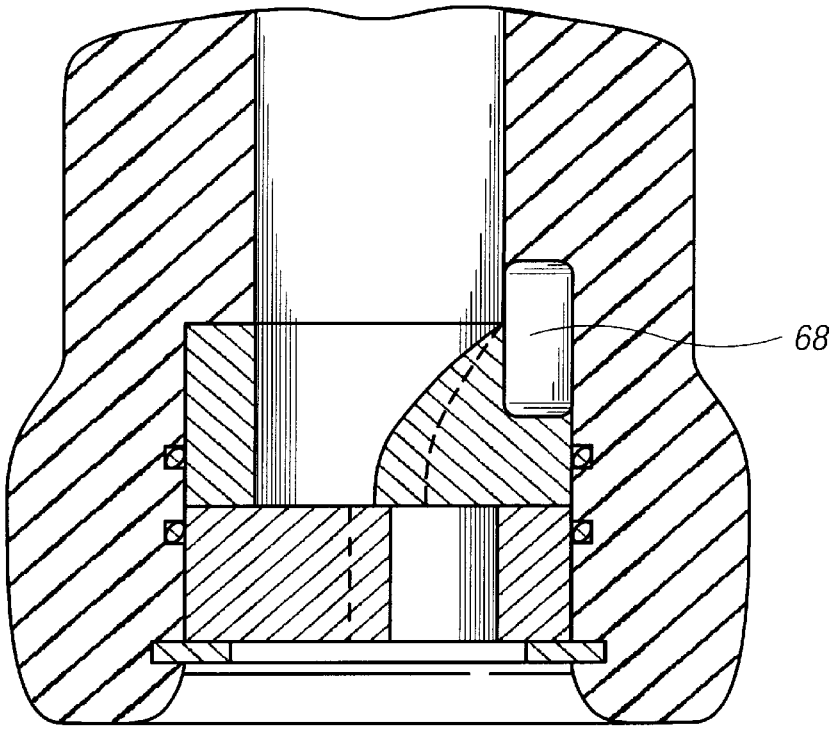
FIG. 9 shows a cross-section of an alternate embodiment of the variable-aperture nozzle.
Figure 10A:
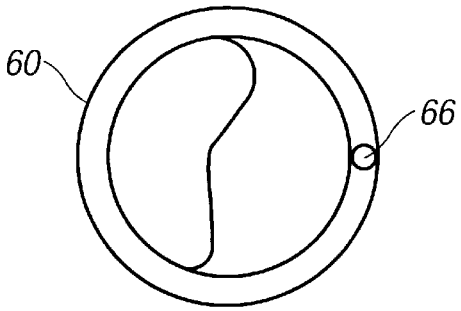
FIG. 10A–B show respectively a view of the bottom and side of the inner ring of the alternate embodiment of FIG. 9.
Figure 11A:
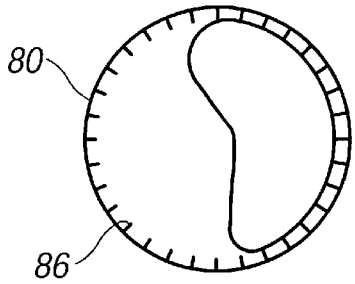
FIG. 11A–B show respectively a view of the bottom and side of the outer ring of the alternate embodiment of FIG. 9.
Figure 10B:
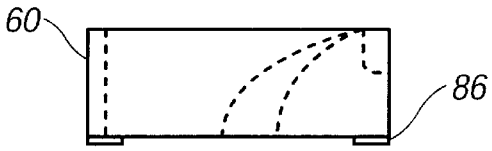
Figure 11B:
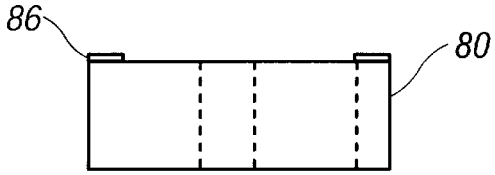

FIG. 8 shows the two plates overlying each other, with a minimal through-opening being shown. By rotating one or both of these plates, the opening can be enlarged until the openings on the two plates are overlying each other, giving the maximum opening possible with this configuration.

Figure 5:
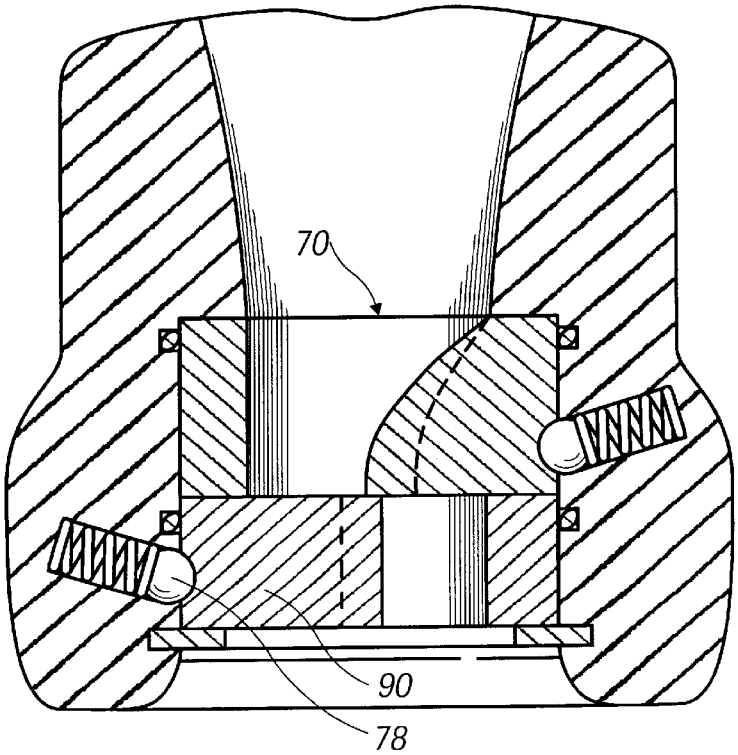
FIG. 5 shows a cross-section of the variable-aperture nozzle.
Figure 6A:
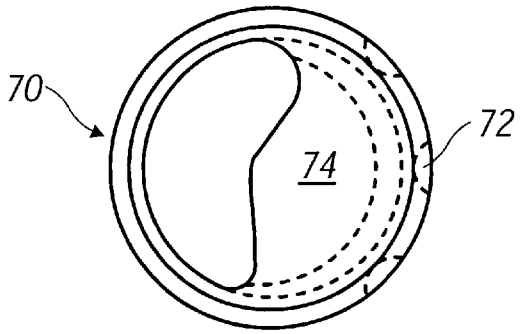
FIGS. 6A–B show respectively a view of the bottom and side of the inner ring of the variable-aperture nozzle.

FIG. 5 shows a cross-section of the flow restrictor plates in place in the nozzle, with their openings in approximately the position shown in FIG. 8. Note the spring-loaded bearings 78 which lock into the indentations on the side of the rings to provide rotational stability. Also seen in this figure are the seals which prevent the high-pressure drilling mud from passing around, rather than through, the two plates. A snap ring holds the plates in place.

The flow restrictor plates discussed above would be factory-installed in the nozzles of the drill bit when it is manufactured. This assures that a more ideal environment is possible at installation, and allows for quality checking of the plates and their installation. If desired, the aperture can be preset to a default setting at the same time. When the drill bit is installed on the floor of the drill rig, the drilling engineer will determine the flow characteristics necessary and adjust the setting of the aperture if necessary. No change of parts is necessary.

Second Embodiment: FIGS. 9–11B

FIGS. 9–11B show an alternate version of the disclosed flow restrictor plates. In FIG. 10A, the inside surface of the inner plate 60 contains a small hole 66 which allows this plate to be locked into a fixed position within the drill bit by a dowel 68, an example of which is seen in cross-section in FIG. 9. Instead of using the method of the first embodiment to adjust the aperture opening, the sides of the two plates which fit against each other have splines 86 around the edge such that the two plates will mate together in various positions. This is most clearly seen in FIG. 11A, which shows the inside surface of outer plate 80, but is also seen in cross-section in FIGS. 9, 10B, and 11B. The thickness of the splines are chosen so that the plate can be rotated against each other when not under pressure. The added pressure of the mud flow will bring force them more tightly together, resisting further movement.

Alternate Embodiment: Inner Ring Integral

In a further alternate embodiment, the inner ring is formed as an integral part of the bit, with only the outer ring being removable.

Alternate Embodiment: Alternate Bit Type

Figure 1:
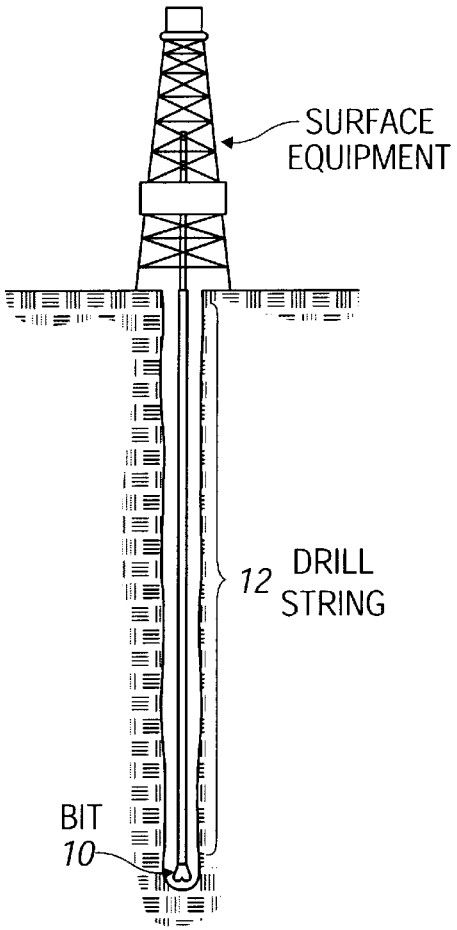
FIG. 1 shows a drill rig which can use a drill bit with the disclosed variable-aperture nozzle.
Figure 4:
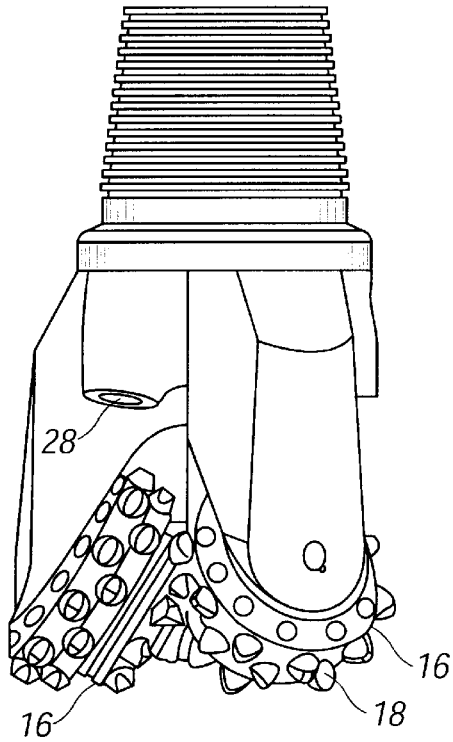
FIG. 4 shows an example of a rotary cone bit which can use the disclosed variable-aperture nozzle.
Figure 3:
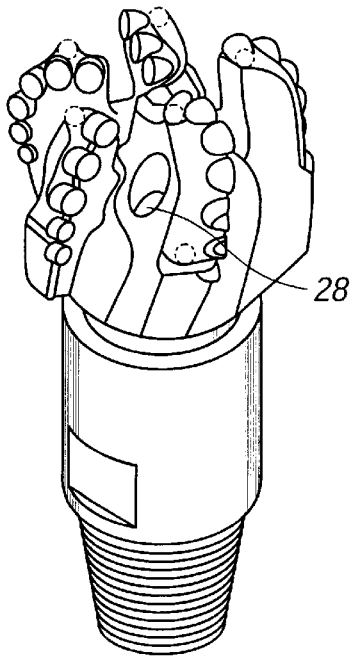
FIG. 3 shows an example of a drag bit which can use the disclosed variable-aperture nozzle.
Figure 2:
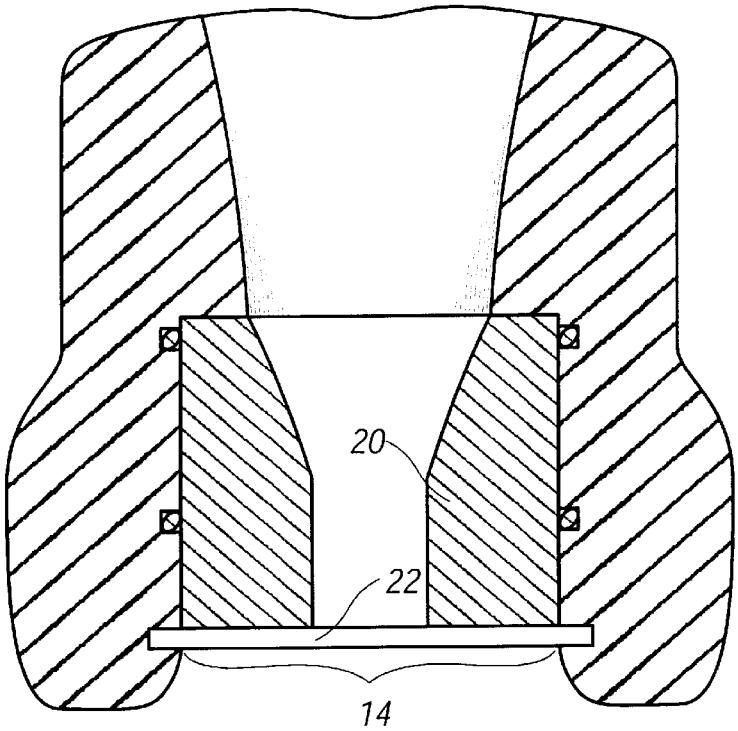
FIG. 2 (PRIOR ART)
FIG. 2 shows a nozzle from the prior art.

In an alternate embodiment shown in FIG. 3, a drag bit, i.e. one with no moving parts, also has the disclosed variable-orifice nozzle. Note that in this example, the nozzle is in a recessed portion of the bit, rather than in a protrusion as seen in FIG. 4.

Alternate Embodiment: Alternate Aperture

The aperture shape of the first two embodiments can variably provide openings which are about 10–50 percent of the area of the plate. By adjusting the size and shape of the opening, this percentage can be adjusted. For example, if the opening on each plate covered approximately two thirds of the area of the plate, the combination of the two plates can provide openings which vary from about 33–66 percent of the plate area. Other designs can provide other ranges.

Definitions:

Following are short definitions of the usual meanings of some of the technical terms which are used in the present application. (However, those of ordinary skill will recognize whether the context requires a different meaning.) Additional definitions can be found in the standard technical dictionaries and journals.

Drag bit: a drill bit with no moving parts that drills by intrusion and drag.

Mud: the liquid circulated through the wellbore during rotary drilling operations, also referred to as drilling fluid. Originally a suspension of earth solids (especially clays) in water, modern "mud" is a three-phase mixture of liquids, reactive solids, and inert solids.

Nozzle: in a passageway through which the drilling fluid exits a drill bit, the portion of that passageway which restricts the cross-section to control the flow of fluid.

Roller cone bit: a drilling bit made of two, three, or four cones, or cutters, that are mounted on extremely rugged bearings. Also called rock bits. The surface of each cone is made up of rows of steel teeth or rows of tungsten carbide inserts.

Variable-aperture: used in this application to mean that the cross-section of an aperture through a part, i.e. through a nozzle, is changeable without replacement of the part.

Field adjustable: used in this application to mean that a part is adjustable outside of the manufacturing facility, i.e., in a warehouse or at the rig site, and that this adjustment does not require any parts to be replaced.

According to a disclosed class of innovative embodiments, there is provided: A bit for downhole rotary drilling, comprising: a plurality of nozzles for the passage of drilling fluid, at least one of said nozzles having an aperture whose size is field-adjustable.

According to another disclosed class of innovative embodiments, there is provided: A bit for downhole rotary drilling, comprising: a plurality of nozzles, at least one of said nozzles comprising a plurality of plates having respective apertures therethrough, one of said plurality of plates being rotatably adjustable to change the pressure drop across said one of said nozzles.

According to another disclosed class of innovative embodiments, there is provided: A bit for downhole rotary drilling, comprising: a body having an internal passage for the delivery of drilling fluid, said body having an attachment portion capable of being attached to a drill string; cutting elements attached to said body; a plurality of nozzles which are connected to said internal passage, at least one of said nozzles comprising a plurality of plates having respective apertures therethrough; wherein one of said plurality of plates is rotatably adjustable to change the pressure drop across said one of said nozzles.

According to another disclosed class of innovative embodiments, there is provided: A rotary drilling system, comprising: a jet bit having a plurality of nozzles, at least one of said nozzles having an aperture whose size can be adjusted without replacement of said nozzle; a drill string which is connected to conduct drilling fluid to said jet bit from a surface location; and a rotary drive which rotates at least part of said drill string together with said bit.

According to another disclosed class of innovative embodiments, there is provided: A method for rotary drilling, comprising the actions of: optimizing a nozzle on a bit for perceived best pressure drop at a given flow rate by changing the size of opening through said nozzle without replacement of said nozzle.

According to another disclosed class of innovative embodiments, there is provided: A method for rotary drilling, comprising the actions of: (a.) rotating a plate within a nozzle on a jet bit, to change the alignment of a first opening in said plate with respect to a second opening in said nozzle, to give a perceived best pressure drop across said nozzle at a given flow rate; (b.) rotating a drill string attached to said jet bit; (c.) pumping drilling fluid through said drill string to said jet bit.

The following background publications provide additional detail regarding possible implementations of the disclosed embodiments, and of modifications and variations thereof. All of these publications are hereby incorporated by reference: APPLIED DRILLING ENGINEERING, Adam T. Bourgoyne Jr. et al., Society of Petroleum Engineers Textbook series (1991), OIL AND GAS FIELD DEVELOPMENT TECHNIQUES: DRILLING, J. -P. Nguyen (translation 1996, from French original 1993), MAKING HOLE (1983) and DRILLING MUD (1984), both part of the Rotary Drilling Series, edited by Charles Kirkley.

Modifications and Variations

As will be recognized by those skilled in the art, the innovative concepts described in the present application can be modified and varied over a tremendous range of applications, and accordingly the scope of patented subject matter is not limited by any of the specific exemplary teachings given.

For example, it is not necessary for the two plates to have identical apertures, although this is certainly the most advantageous configuration.

What is claimed is:

1. A bit for downhole rotary drilling, comprising:

a plurality of nozzles for the passage of drilling fluid, at least one of said nozzles comprising a plurality of plates having respective apertures therethrough, one of said plurality of plates being rotatably adjustable to change the pressure drop across said one of said nozzles, wherein said one of said plates contains indentations which are locking points for a spring-loaded ball bearing.

2. The bit of claim 1, further comprising a body which is connected to said nozzles, said body also being attached to cutting elements.

3. The bit of claim 1, wherein the velocity of drilling fluid from said nozzles is a hundred feet per second or greater.

4. The bit of claim 1, wherein said bit is a roller cone bit.

5. The bit of claim 1, wherein said bit is a drag bit.

6. The bit of claim 1, further comprising:

a body having an internal passage for the delivery of drilling fluid, said body having an attachment portion capable of being attached to a drill string;

cutting elements attached to said body;

wherein said internal passage is in communication with said plurality of nozzles.

7. A bit for downhole rotary drilling, comprising:

a plurality of nozzles, at least one of said nozzles comprising a plurality of plates having respective apertures therethrough, one of said plurality of plates being rotatably adjustable to change the pressure drop across said one of said nozzles, said plates having splines around the edge such that the two plates will mate together in various positions.

8. The bit of claim 7, wherein said drilling fluid leaves said nozzles at velocities of 100 feet/second or greater.

9. The bit of claim 7, wherein a second one of said plurality of plates is held in a fixed position within said bit.

10. The bit of claim 7, wherein one of said plates is an integral part of a body on which said nozzles are mounted.

11. The bit of claim 7, further comprising:

a body having an internal passage for the delivery of drilling fluid, said body having an attachment portion capable of being attached to a drill string;

cutting elements attached to said body;

wherein said internal passage is in communication with said plurality of nozzles.

12. A rotary drilling system, comprising:

a jet bit having a plurality of nozzles, at least one of said nozzles comprising a plurality of plates having respective apertures therethrough, one of said plurality of plates being rotatable adjustable to change the pressure drop across said one of said nozzles, said plates having splines around the edge such that the two plates will mate together in various positions;

a drill string which is connected to conduct drilling fluid to said jet bit from a surface location; and a rotary drive which rotates at least part of said drill string together with said bit.

13. The rotary drilling system of claim 12, wherein said jet bit further comprises:

a body having an internal passage for the delivery of drilling fluid, said body having an attachment portion capable of being attached to a drill string, said internal passage being connected to said plurality of nozzles; and cutting elements attached to said body.

14. A rotary drilling system, comprising:

a jet bit comprising a plurality of nozzles, one of said nozzles comprising a plurality of plates having respective apertures therethrough, one of said plurality of plates being rotatably adjustable to change the pressure drop across said one of said nozzles, wherein said one of said plates contains indentations which are locking points for a spring-loaded ball bearing.

a drill string which is connected to conduct drilling fluid to said jet bit from a surface location; and a rotary drive which rotates at least part of said drill string together with said bit.

15. The rotary drilling system of claim 14, wherein said jet bit further comprises:

a body having an internal passage for the delivery of drilling fluid, said body having an attachment portion capable of being attached to a drill string, said internal passage being connected to said plurality of nozzles; and cutting elements attached to said body.

* * * * *